US005286315A

United States Patent [19]

Iwayama et al.

[11] Patent Number: 5,286,315

[45] Date of Patent: Feb. 15, 1994

[54] PROCESS FOR PREPARING ROLLABLE METAL SHEET FROM QUENCHED SOLIDIFIED THIN CAST SHEET AS STARTING MATERIAL

[75] Inventors: Kenzo Iwayama; Isao Iwanaga; Kenichi Miyazawa; Toshiaki Mizoguchi, all of Kitakyushu; Hidehiko Sumitomo, Hiraki, all of Japan

[73] Assignee: Nippon Steel Corporation, Tokyo, Japan

[21] Appl. No.: 956,931

[22] PCT Filed: Mar. 30, 1990

[86] PCT No.: PCT/JP90/00442

§ 371 Date: Nov. 29, 1990

§ 102(e) Date: Nov. 29, 1990

[87] PCT Pub. No.: WO90/11849

PCT Pub. Date: Oct. 18, 1990

Related U.S. Application Data

[63] Continuation of Ser. No. 613,862, Nov. 29, 1990, abandoned.

[30] Foreign Application Priority Data

Mar. 30, 1989 [JP] Japan ..... 1-79981
Mar. 30, 1989 [JP] Japan ..... 1-79982
Mar. 30, 1989 [JP] Japan ..... 1-79983

[51] Int. Cl.[5] ..... C21D 8/12

[52] U.S. Cl. ..... 148/538; 148/541; 148/546; 148/551; 148/552; 148/554; 148/556; 148/557; 148/111; 164/476; 29/527.7

[58] Field of Search ..... 148/538, 541, 546, 551, 148/552, 554, 556, 557, 111; 164/476; 29/527.7

[56] References Cited

U.S. PATENT DOCUMENTS 4,799,974 1/1989 Mahoney et al. ..... 148/12.7 A
4,909,859 3/1990 Nazmy et al. ..... 148/11.5 N
4,969,593 11/1990 Kennedy et al. ..... 148/11.5 A

FOREIGN PATENT DOCUMENTS 0108490 5/1984 European Pat. Off. .
55-69223 5/1980 Japan .
55-122872 9/1980 Japan .
57-38654 8/1982 Japan .
58-56013 12/1983 Japan .
59-46287 11/1984 Japan .
60-56020 4/1985 Japan .
60-38462 8/1985 Japan .
61-67720 4/1986 Japan .
61-195919 8/1986 Japan .
0222611 10/1986 Japan ..... 148/2
62-19724 8/1987 Japan .
63-11619 1/1988 Japan .
63-72824 4/1988 Japan .
63-83224 4/1988 Japan .
2085034 4/1982 United Kingdom .

OTHER PUBLICATIONS

European Search Report EP 90 90 5626.
"Seitestu Kenkyu (Study in Iron Manufacturing)" N 292 (1977), pp. 100–112 (with partial translation).

*Primary Examiner*—Richard O. Dean
*Assistant Examiner*—Sikyin Ip
*Attorney, Agent, or Firm*—Kenyon & Kenyon

[57] ABSTRACT

The present invention relates to a process for preparing a metal sheet having an excellent rolling property, i.e., a rollable metal sheet, which process comprises the basic steps of: continuously feeding a molten metal on a cooling material having one or two cooling surfaces being transferred and renewed for quench solidification, to thereby prepare a thin cast sheet; impinging a small rigid body particle against the surface of the resultant thin cast sheet, to work the cast sheet; heat-annealing the worked sheet in such a manner that the worked region becomes a fine recrystallized grain layer; and subjecting the cast sheet to a cold or warm rolling, optionally after a removal of oxides present on the surface; and an optional step of heat-treating the rolled sheet for working. The process of the present invention is applicable to the production of various known rollable metal or alloy sheets, such as soft steel, stainless steel, silicon steel, nickel-iron, cobalt-iron, nickel, aluminum, and copper sheets.

14 Claims, 2 Drawing Sheets

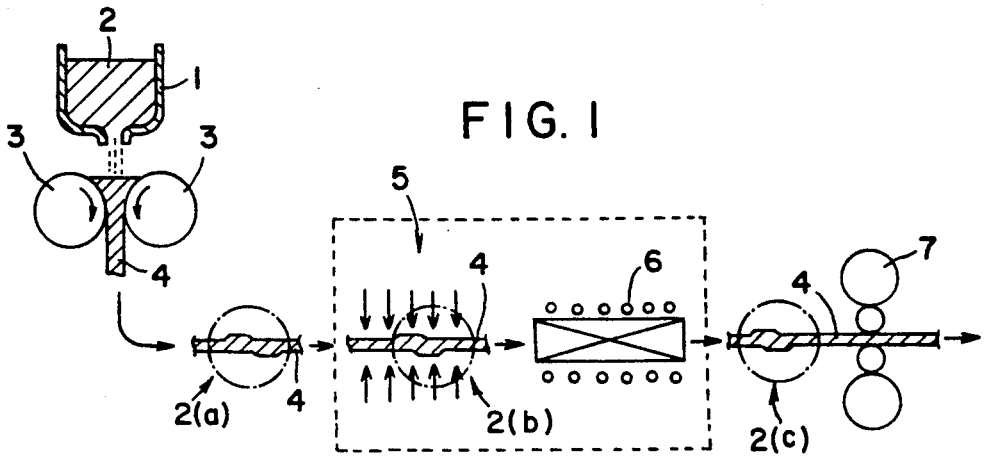
FIG. 1
FIG. 2(a)
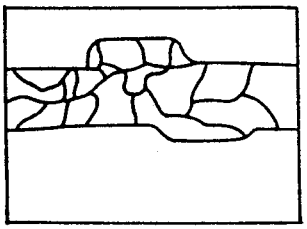
FIG. 2(b)
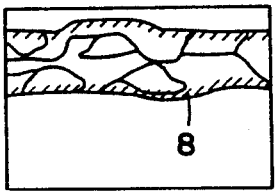
FIG. 2(c)
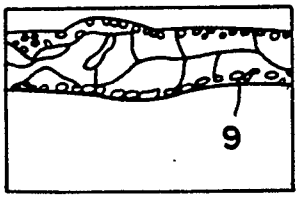

PROCESS FOR PREPARING ROLLABLE METAL SHEET FROM QUENCHED SOLIDIFIED THIN CAST SHEET AS STARTING MATERIAL

This application is a continuation of application Ser. No. 07/613,862 filed Nov. 29, 1990, now abandoned.

TECHNICAL FIELD

The present invention relates to a process for preparing a rollable metal sheet from a quench solidified thin cast sheet as a starting material capable of providing a good rolled shape when rollable metal sheets including various alloy sheets, such as soft iron, stainless steel, silicon steel, nickel-iron (permalloy), cobalt-iron (permendur), nickel, aluminum and copper sheets are prepared from a quench solidified thin cast slab or cast thin strip (hereinafter generally referred to as "thin cast sheet") as a starting material.

BACKGROUND ART

Conventionally, various rollable metal sheets are produced by, for example, (i) a continuous casting to prepare a 200 mm-thick cast slab, (ii) heating the slab, (iii) hot rolling, (iv) annealing the hot rolled material, (v) cold rolling, and (vi) an optional heat treatment for working. Recent demands for a reduction in production costs have led to proposals of various methods of eliminating the above-described steps (ii) and (iii) including the single roll and twin roll methods, which comprise continuously feeding a molten metal onto a cooling material having one or two cooling surfaces being transferred and renewed for quench solidification, thereby preparing a thin cast sheet having a thickness of several ten μm to about 10 mm. The above-described single and twin roll methods, etc., provide a rollable metal with a high productivity at a low cost but are plagued by several fundamental problems, and therefore, currently the technology in this field is incomplete, although some products have been put to practical use.

Among the above-mentioned problems, one of the most serious is a loss of the rolling property. In general, contrary to the smooth surface of a hot rolled sheet prepared by the conventional hot rolling process, the surface of a thin cast sheet prepared by the single roll method, twin roll method or the like often has an unevenness of as much as several ten % or more of the sheet thickness, due to rippling, and further, suffers from large variations in the thickness of the sheet in the width direction thereof.

This is a defect inherent to the quench solidifying system and is attributable to a localized difference in the shrinkage accompanying the solidification of the molten metal and a thermal deformation of the roll surface, etc., and can be avoided to some extent by attention to the design and operation of the machinery. This alleviation, however, is limited because, in a rollable metal sheet prepared by a series of production steps wherein a cold rolling or warm rolling step is essential, a ripple or the like on the surface of the metal is squeezed in the rolling direction during the rolling and causes a dimple to be formed in the direction of the sheet body; this is the cause of the occurrence of "scab". The above-described uneven portion also is often a cause of a cracking of a fragile material during cold rolling. In recent years, various methods have been proposed, including a method which comprises casting a soft iron sheet or a stainless steel sheet to a thickness of several ten μm to several mm through a single or twin roll method, and annealing and cold rolling the sheet to prepare a foil strip having a thickness of several ten μm to several hundred μm. Nevertheless, in this method also, the uneven portion present in the thin cast sheet is a cause of contraction or breaking during the cold rolling. As described above, compared to the conventional hot rolling process, the single or twin roll method is an excellent production method having not only the merit of a reduction of costs, such as an elimination of steps and the need for less plant and equipment investment, but also having an advantage in that a cold rolled material having a thickness as small as about several ten μm can be directly prepared. These methods, however, have not been put to practical use, due to problems with the rolling process.

In particular, when the above-described thin cast sheet is used as a starting material for stainless steel sheets, technical problems having an influence on the product quality, such as corrosion resistance, appearance, gloss, polishing property and further, in BA products, streaks and defects called "gold dust", exist on the surface of the steel sheet.

The problem of the surface of the stainless steel sheet has hitherto been solved by conducting a mechanical descaling and pickling after annealing the hot rolled sheet, polishing the whole surface of the coil to remove various defects, and cold-rolling the coil with a large number of passes using a sendzimir mill comprising a multiple roll having a small diameter. A process comprising the steps of annealing, picking, surface polishing, and cold rolling by a small diameter roll is an established technique for preparing a thin strip of stainless steel having a fine surface, and 2D, 2B, and BA products specified in JIS have been produced thereby. The manufacturing techniques for these products are disclosed in detail in Sawatani et al, "Seitetsu Kenkyu (Study in Iron Manufacturing)", N292 (1977), p. 100. Further, to satisfy the need for an elimination of steps, studies have been made into the elimination of the steps of annealing the hot rolled sheet and of surface polishing (see Japanese Examined Patent Publication Nos. 57-38654, 59-46287 and 58-56013). In these studies, however, it was found that the elimination of these steps often has an adverse affect on the surface appearance.

In addition to the above-described prior art, when a product is prepared through the use of the above-described thin cast sheet as a starting material, by the conventional process, compared to the conventional process wherein use is made of a hot rolled sheet as a starting material, the crystal grain of the product becomes large, which leads to serious defects, and thus this step reducing process cannot be put to practical use.

As described above, all of the prior art processes aim at a mirror polish effect on the steep sheet, obtained from the roll, or a change in the dispersed state of a carbide of a steel sheet, and do not always provide a satisfactory solution to the problem. Further, when a thin cast slab, in which recent remarkable developments have been made, is used as a starting material, a problem arises in that a grain pattern is formed in the product if only the prior art method is applied. Therefore, a novel and useful method of solving the above problem is required.

When a unidirectional silicon steel is used as the starting material for the above-described thin cast sheet, a proposal has been made for a technique that will solve a problem of the conventional process for preparing a unidirectional silicon steel sheet, i.e., a problem of a limitation of the silicon content to 4% or less, for example, as disclosed in Japanese Unexamined Patent Publication Nos. 55-69223 and 60-38462, a process for preparing a cold-rollable high silicon steel sheet through the use of a starting material comprising a cast slab having a thickness of not more than several hundred μm prepared by continuously feeding a molten metal containing 4 to 10% by weight of silicon, etc., onto a cooling material having a cooling surface being transferred and renewed to quench the molten metal. A similar method is disclosed in Japanese Unexamined Patent Publication No. 63-11619. This method is applied to a cast slab having a thickness of 0.7 to 2.0 mm.

All of the silicon steel sheets prepared by the above-described improved method exhibit a good mechanical property when the silicon content is high, but are unsatisfactory from the viewpoint of obtaining a high magnetic property, and stably reproducing these properties.

Specifically, the process for preparing an unidirectional silicon steel sheet wherein use is made of a step of preparing a thin cast sheet by quench solidification is advantageous in that it is possible to eliminate the hot rolling step and increase the silicon content, but is unsatisfactory in the attaining of excellent properties and in the reproducibility of the conventional material subjected to the hot rolling. Further, a satisfactory cold rolling property is not attained in a high silicon content material.

DISCLOSURE OF THE INVENTION

An object of the present invention is to provide a method which solves the problem of the loss of the cold rolling property, which is a serious problem common to the production of a rollable metal sheet from a starting material comprising a quench solidified thin cast sheet prepared by the above-described single or twin roll method, i.e., to remarkably alleviate the fundamental difficulties encountered by the single or twin roll method when putting these methods to practical use.

An object of the present invention is to provide a novel method of improving the surface appearance of a thin cast sheet for general stainless steels, wherein the surface appearance is considered important in a cold rolled sheet or in the stage of final annealing, without a limitation to an austenitic stainless steel typically comprising 18% Cr-8% Ni or a ferritic stainless steel typically comprising 16.5% Cr. Further, another object of the present invention is to provide a process for stably preparing a unidirectional silicon steel having a low core loss, through a suitable regulation of the integrity and grain size of a {110} <001> secondary recrystallized grain of a unidirectional silicon steel in a thin cast sheet form.

The present inventors made various studies with a view to solving the above-described problems of the prior art, and as a result, found that a particular working followed by a recrystallization of a fine grain in the worked region by annealing will suitably solve the above-described problems of the loss of the rolling property, etc., and thus completed the present invention.

Accordingly, the object of the present invention is to provide a process for preparing a metal sheet having an excellent rolling property, etc., i.e., a rollable metal sheet, which process comprises the basic steps of: continuously feeding a molten metal onto a cooling material having one or two cooling surfaces being transferred and renewed for quench solidification, to thereby prepare a thin cast sheet preferably having a thickness of 10 μm to about 6 mm; impinging a small rigid body particle onto the surface of the resultant thin cast sheet, to work the cast sheet; heat-annealing the worked sheet in such a manner that the worked region becomes a fine recrystallized grain layer; and subjecting the sheet to a cold or warm rolling, optionally after a removal of oxides present on the surface; and an optional step of heat-treating the rolled sheet for working.

When a rollable metal sheet is prepared from a starting material comprising a quench solidified thin cast sheet formed by the single or twin roll method, the cold rolling property with regard to the surface smoothness, sheet thickness controllability, and frequency of occurrence of problems such as a breaking of the metal sheet prepared by the prior art method is for inferior to a sheet subjected to hot rolling. In contrast, according to the present invention, the cold rolling property and surface appearance can be remarkably improved through the introduction of the above-described step of working and the step of recrystallizing a fine grain in the worked region.

Further, even in the case of a unidirectional silicon steel having a high silicon content and a small thickness, the secondary recrystallization can be remarkably stabilized, and the grain size made small, which makes it possible to prepare a unidirectional silicon steel sheet having a core loss of about 5% or more, which is superior to that of the conventional product. Further, the fine recrystallization at the surface portion of the cold rolling material steel sheet according to the present invention has the effect of not only improving the secondarily recrystallized grain but also remarkably improving the cold rolling property, so that according to the present invention, even a cast slab having a high silicon content and a thickness of up to 2.5 mm can be advantageously cold-rolled, compared to the known quench solidification method, for example, a method disclosed in Japanese Unexamined Patent Publication No. 63-11619, wherein the upper limit of the thickness of the cast slab is 2.0 mm.

The reasons why the production conditions in the present invention are limited as described above will now be described in detail.

There is no particular limitation on the metal used in the present invention, and a thin cast sheet prepared by the single or twin roll method, i.e. by continuously feeding a molten metal onto a cooling material having one or two cooling surfaces being transferred and renewed for quench solidification, is used as a starting material. The present invention can be advantageously applied to the production of various known rollable metal or alloy sheets, such as soft steel, stainless steel, silicon steel, nickel-iron, cobalt-iron, nickel, aluminum and copper sheets because, in these materials, the worked region can be finely crystallized through the steps of working and annealing, which are essential in the present invention, and the fine crystallization enables a remarkable improvement of the cold rolling property.

The reason why the thickness of the thin cast sheet is preferably limited to 10 μm to 6.0 mm is as follows. When the thickness exceeds 6.0 mm, the advantage of the elimination of the step is reduced and a relatively good rolling property can be obtained without the use of the present invention because, even when uneven portions exist, the proportion thereof in the whole sheet thickness is small. The thickness must be 10 μm or more because there is substantially no need to use a starting material having a thickness of less than 10 μm, as rolling is conducted in the present invention as an indispensable step and it is almost impossible to prepare a thin cast sheet having a thickness of less than 10 μm.

In the case of a grain oriented silicon steel, the thickness is preferably 0.5 to 2.5 mm.

The thin cast sheet prepared by the quench solidification method is then worked by impinging a small rigid body particle against the surface of the cast sheet. Specifically, a numerous number of particles of iron, sand or other material are impinged at a high speed against the surface of the thin cast sheet, for working; i.e., the thin cast sheet is subjected to blasting. "Grit" having an irregular shape and very sharp, or a shot having a relatively spherical shape, are used as the particles for the working. To impinge the above-described particles at a high speed, in general, use is made of a centrifugal projecting apparatus wherein the particles are accelerated by the rotation of a blade of a disk wheel, or a pneumatic blasting apparatus wherein compressed air ejected from a nozzle is utilized.

preferably, the above-described working is applied to both surfaces, these surfaces including a side edge face or one surface depending upon the surface appearance, because a working of one surface causes warping.

Regarding the size of the grit, shot, etc., the use of a large size shot not only increases the depth of the worked region but also increases the size of the impressions, and consequently, increases the surface roughness. In general, the size is preferably two times to a fraction of the thickness of the thin cast sheet. The blasting time varies depending upon the type of metal, the unevenness of the thin cast sheet, and the purpose thereof, etc., but the working must be conducted in such a manner that substantially no unworked region exists and at least the surface of the sheet is covered with a fine recrystallized grain in the subsequent annealing.

The thin cast sheet thus worked is then heat-annealed. The optimum temperature varies, depending upon the type of metal; for example, heating is preferably conducted at 650° to 1300° C. for silicon-iron steel, stainless steel and nickel-iron, at 350° to 900° C. for copper, and at 300° to 600° C. for aluminum, for zero second to several hours.

The thin cast sheet wherein at least the surface thereof is covered with a fine recrystallized grain through the heat annealing is subjected to a step of removing an oxide, etc., present on the surface thereof according to need, and then to a series of steps including cold or warm rolling as a basic step depending upon the purpose, and then optionally, a heat treatment for working, to thereby prepare a final product.

It is believed that the cold rolling property of the quench solidified thin cast sheet is improved by the present invention through the following mechanism. The grit or shot blasting has the effect of smoothing uneven portions, particularly the boundary regions thereof present on the surface of the thin cast sheet, and the smoothing effect reduces "rippling", etc., during rolling.

The most important feature of the present invention is that the cold rolling is conducted in a state such that the surface of the thin cast sheet is covered with a fine recrystallized grain.

When a rolling roll is partially in contact with a surface of a thin cast sheet having an uneven portion, the "drape" between the surface of the thin cast sheet having an uneven portion and the surface of rolling roll is poor, due to a relationship thereof with the deformation mode if surface particles are coarse. On the other hand, when the surface grain comprises a fine recrystallized grain, the "drape" between both surfaces is good, and the whole surface can be leveled with a very small rolling reduction. This difference in the "drape" between the coarse grain and the fine grain is believed to exist because, when the surface grain is coarse, the deformation due to a particular simple slip system occurs over a relatively wide region and the constraint on adjacent grains is large, and thus the external shape of each grain is not always adhered to the roll surface, but when the surface grain is fine, the deformation of each grain occurs over a narrow region, which enables the external shape of each grain to be always adhered to the roll surface.

As described above, the present invention enables a metal sheet useful to the industry to be prepared from a quench solidified thin cast sheet.

BRIEF DESCRIPTION OF THE DRAWINGS

FIG. 1 is a schematic explanatory view showing the process of the present invention;

FIG. 2 is a schematic diagram of a photomicrograph showing a state of formation of a fine recrystallized grain layer on the surface of a thin cast sheet having a sagging portion, according to the present invention.

BEST MODE OF CARRYING OUT THE INVENTION

Figure 3:
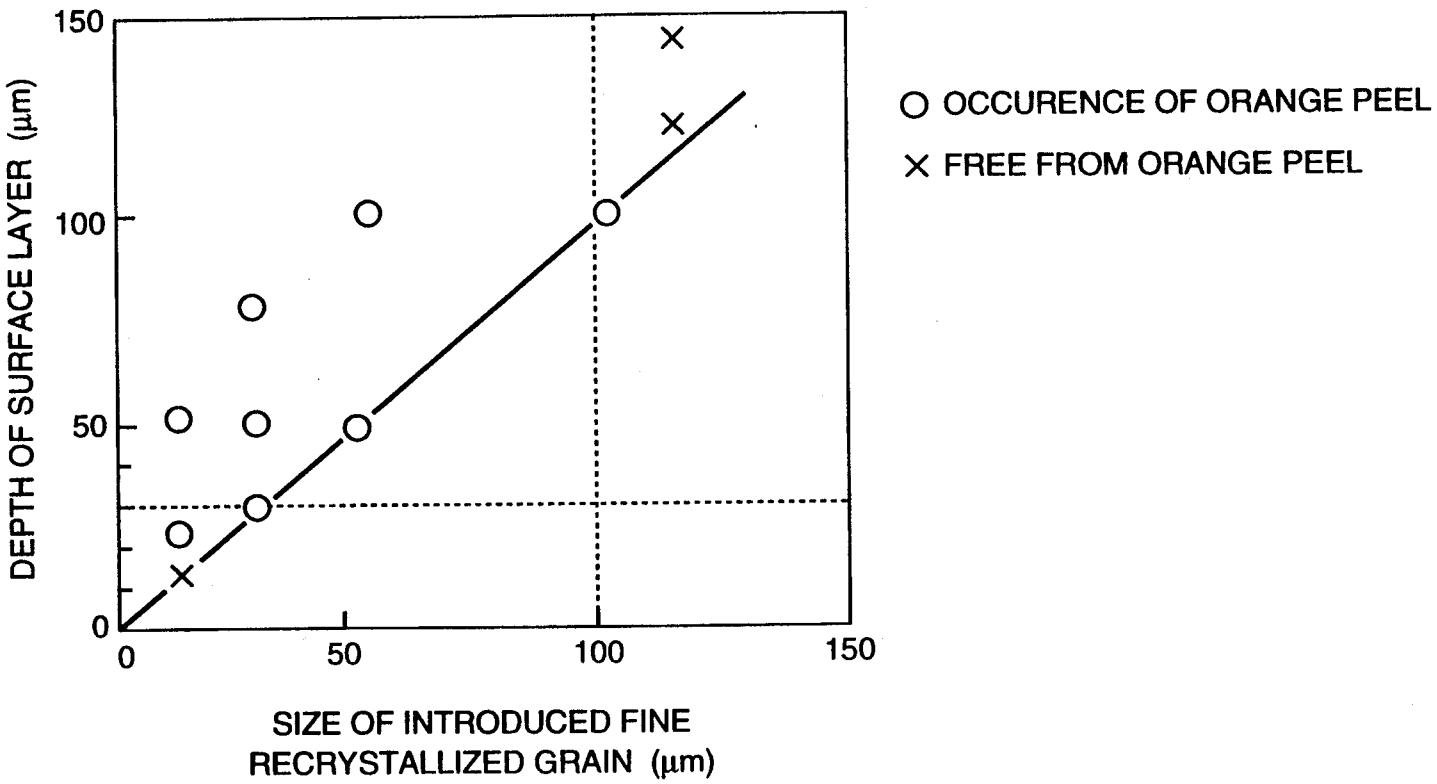
FIG. 3 is a diagram showing the relationship between the fine crystal grain size and the depth of the grain layer from the surface thereof, in the process of the present invention (stainless steel), in relation to a surface defect.

The present invention will now be described in more detail with regard to the case wherein the molten metal is a stainless steel and a unidirectional electrical sheet.

First a description will be given with reference to a stainless steel thin case sheet.

The stainless steel used in the present invention is formed of a stainless steel comprising known ingredients, and as described above, must be subjected to shot blasting and heat annealing (annealing for softening) before cold rolling.

FIG. 1 is a schematic explanatory view showing the process of the present invention. A molten metal 2 in a tundish 1 is poured between cooling rolls 3 and is quench-solidified in a gap between the rolls 3 to form a thin cast sheet 4. The surface of the thin cast sheet 4 is subjected to blasting by a shot blasting apparatus 5. The worked sheet is annealed for softening by a heat annealing apparatus 6, scale is removed, and the sheet is cold rolled by a cold rolling mill 7.

FIG. 2(*a*) is a schematic view of a microphotograph wherein the sagging portion A of the thin cast sheet 4 shown in FIG. 1 is subjected to surface working and annealing.

FIG. 2(*b*) shows a worked layer 8 formed on the surface of sagging portion A when it is subjected to blasting. The acute angle portion disappears.

FIG. 2(*c*) shows a fine recrystallized grain layer 9 which is formed when the sagging portion A is annealed for softening.

In the present embodiment, as shown in FIG. 3, the above-described fine recrystallized grain 9 having an average diameter of 100 μm or less must be formed as a surface layer having a depth of 30 μm or more on the thin cast sheet.

FIG. 3 shows the results of an observation of the surface appearance of metal sheets prepared by subjecting a 3 mm-thick thin cast slab of SUS 304 comprising a coarse crystal grain to shot blasting under various conditions, annealing the worked slab at 1100° C. for various times, to vary the size of a fine crystallized grain and the depth of a surface layer, removing scale with aqua regia, and cold-rolling the slab at a draft of 70%. It is apparent that, when outside the scope of the present invention, the cold rolling causes a rough surface, e.g., "orange peel", to be formed due to the coarse crystal grain of the thin cast slab.

Accordingly, the above-described fine recrystallized grain must be used in the present embodiment.

To produce the above-described fine recrystallized grain after annealing for softening, a rigid body particle, such as shot or grit, is projected onto the steel sheet before the annealing for softening, to thereby form a worked layer on the surface layer of the steel sheet. Specifically, a large number of particles of iron, sand or other material are impinged at a high speed onto the surface of the thin cast sheet, for working. The blasting may be conducted under the same conditions as described above.

The thus blasted thin cast sheet is then annealing for softening. In the present embodiment, heat annealing at a temperature of 700° to 1300° C. for one sec to 10 min may be conducted, to recrystallize the grain to the above-described state. When the annealing temperature and time are lower than 700° C. and shorter than 1 sec, respectively, no recrystallization occurs. On the other hand, when the annealing temperature and time are more than 1300° C. and 10 min, respectively, this is not only cost-inefficient but also it becomes difficult to prepare a fine grain due to the growth of the crystal grain.

In the present embodiment, the surface defect of the cold-rolled sheet is alleviated through the following mechanism. Specifically, in the present embodiment, when the cold rolling is conducted in a state such that the surface of a thin cast sheet is covered with a fine recrystallized grain, the "drape" between the surface of the thin cast sheet and the surface of the rolling rolls becomes good, which causes the surface of the thin cast sheet to be actively polished, whereby a mirror surface is obtained. If the surface grains of the thin cast sheet are coarse, each crystal grain tends to have an external shape different from the surface of the rolls, due to the relationship with a slip system of the crystal grain. That is, it is believed that the formation of patterns different from particle to particle can be avoided because the "drape" with the surface of the rolling rolls becomes poor.

As described above, according to the present embodiment, it becomes possible to prepare a thin stainless steel sheet having an excellent surface appearance.

A description will now be made of a gain oriented silicon steel.

In the present embodiment, the steel composition is limited to 2.5 to 6.5% by weight of silicon, an inhibitor ingredient necessary for a gain oriented steel sheet, with the balance being iron and unavoidable impurities. When the silicon content is less than 2.5%, a γ phase is formed at a high temperature, which makes it unable to use a final annealing temperature of 1000° C. or higher due to the growth of a secondary recrystallization, so that substantially no magnetic property can be secured. For this reason, the silicon content is limited to 2.5% or more. On the other hand, the upper limit of the silicon content is set to 6.5% for the reason that, when the silicon content exceeds 6.5%, the cold rolling property becomes remarkably poor because the steel sheet becomes remarkably embrittled.

The effect of the present embodiment can be obtained in a gain oriented silicon steel sheet containing any known inhibitor ingredient. There is no particular limitation on the ingredients of the intended steel sheet, and the steel sheet may comprise 0.0005 to 0.10% of C, 0.02 to 0.35% of Mn, 0.0005 to 0.040% of sol. Al, 0.0005 to 0.04% of S, 0.0005 to 0.012% of N, 0.04% or less of Se, and 0.4% or less of at least one of Sn, Sb, As, Bi, Cu, Cr and Ni.

According to the present embodiment, a molten metal having the above-described composition is then continuously fed onto a cooling material having one or two cooling surfaces being transferred and renewed for quench solidification, thereby preparing a thin cast sheet having a thickness of 0.5 to 2.5 mm. In this case, when the thickness exceeds 2.5 mm, the cooling rate becomes too low. On the other hand, when the thickness is less than 0.5 mm, it becomes difficult to conduct cold rolling with a final cold rolling draft of 80 to 98%. For these reasons, the thickness is preferably 0.5 to 2.5 mm. After solidification, the thin cast sheet having a thickness of 0.5 to 2.5 mm prepared by the above-described casting method is cooled to 1000° C. at a cooling rate of $10^2$ to $10^4$° C./sec. Thereafter, the thin cast sheet usually peels from the cooling material. In this case, it is preferred to spray water or warm water for cooling.

The thin cast sheet thus prepared is then subjected to an essential step of the present embodiment. Specifically, a small rigid body particle is impinged against the thin cast sheet, for working the surface portion. A suitable size of the small rigid body particle varies depending upon the shape of the particle, impact speed, and incident angle, etc., but the particle size is preferably 0.2 to 2 times the thickness of the thin cast sheet. The shape of the particle is preferably angular rather than spherical. The surface of the thin cast sheet should be covered with impressions made by the impact of the small particles.

The thin cast sheet is annealed for recrystallization at 650° to 1300° C. for 30 min or less. When the temperature is lower than 650° C., it is difficult to conduct recrystallization. On the other hand, when the temperature is higher than 1300° C., the inhibitor and structure become poor. When the heating time is longer than 30 min, the cost efficiency is lost. Therefore, the annealing time is limited as described above. When the heating temperature is low, the heating should be conducted for a long time, for example, at 700° C. for 25 min, and when the heating temperature is high the heating should be conducted for a short time, for example, at 1250° C. for 10 sec.

The thin cast sheet thus prepared is subjected to intermediate annealing, etc., according to need, repeatedly cold-rolled, and subjected to cold rolling as a final cold rolling at a draft of 80 to 98%. When the draft is less than 80%, the integrity of the secondarily recrystallized grain prepared after final annealing often becomes poor in the {110} <001> orientation. On the other hand, when the cold rolling draft is higher than 98%, it becomes difficult to ensure the secondary recrystallization.

The cold rolled sheet is then annealed at 600° to 1300° C. at least once. In the case of a relatively thin cast sheet, a secondary recrystallization can be attained even when the carbon content is e.g., 0.0030% or less. In this case, annealing for the secondary recrystallization may be conducted only once at 900° to 1300° C. In general, however, since carbon is contained in an amount of 0.0050% or more, it is preferred to conduct the decarburizing annealing at 750° to 900° C. in a wet hydrogen gas stream, followed by the second annealing as a final annealing at 900° to 1300° C.

In the present embodiment, it is believed that the integrity of grains having a {110} <001> orientation and the size of the secondarily recrystallized grain are improved by the formation of a fine recrystallized grain on the surface of a cold rolled steel sheet, through the following two mechanisms.

One of the two mechanisms is the formation of a Goss nucleus, and the other is the homogenization of the primarily recrystallized matrix. In general, the secondarily recrystallized grains having a {110} <001> orientation of a gain oriented silicon steel sheet product is formed through the growth of a grain having a {110} <001> orientation among primarily recrystallized grains while eating out primarily recrystallized grains adjacent thereto. In this connection, a theory commonly accepted in the art through studies in recent years is that the origin of the "Goss nucleus" present in the primarily recrystallized grain structure exists as a Goss nucleus origin grain on the surface of the hot-rolled material. When the thin cast sheet is used as a cold rolling material as in the present invention, however, compared to the hot rolled sheet, the number of grains having an orientation suitable for the formation of the Goss nucleus is small and the grain having a {100} <ovw> orientation occupies the major portion of the grains. It is believed that a grain having an orientation corresponding to the Goss nucleus origin grain is introduced by subjecting the above-described thin cast sheet to working and recrystallization according to the present embodiment. The other mechanism for improving the property is that, as with the present embodiment, the existence of a fine crystal grain on a grain of the surface limits the growth of grain in the central portion of the steel sheet, and consequently, homogenizes the primarily recrystallized matrix. The homogenization of the primarily recrystallized matrix means a smooth growth of Goss nucleus having a good orientation, i.e., a {110} <001> orientation, and an improvement of the magnetic properties.

As described above, according to the present invention, it becomes possible to stably prepare a grain oriented silicon steel sheet having a {110} <001> orientation valuable in the industry at a low cost while ensuring excellent properties thereof.

EXAMPLE 1

Permalloy PC comprising 76% nickel, 4.5% copper, and 4.5% molybdenum, with the balance being iron and unavoidable impurities, was vacuum melted, and a 0.30 mm thick thin cast sheet was prepared therefrom by a twin roll having a roll diameter of 300 mm. The surface of the thin cast sheets had a recessed portion in a streak form and a sag. The thin cast sheet was divided into two groups, i.e., groups A and B. The sheets of group B were subjected to sand blasting by using sand having a particle diameter of 0.4 mm. Thereafter, the sheets of groups A and B were heat-annealed at 1100° C. for 300 sec, descaled with aqua regia, and rolled to 0.10 mm by a cold rolling mill.

The structure of the section of the material immediately after heat annealing was observed, and as a result, it was found that, in the materials of group B, a layer of a fine grain having a diameter of about 30 to 50 μm was formed in a 0.1 mm region on both surfaces.

Some materials of group A brought about the formation of a pore and broke, and all the materials of group B were rollable. The above cold rolled materials were cut to a width of 1 cm, coated with MgO as an annealing releaser, wound in a toroidal form, maintained in a dry hydrogen gas stream at 1100° C. for 3 hr, and subjected to furnace cooling at a cooling rate of 100° C./hr. The magnetic properties of the materials were determined, and as a result, it was found that as shown in Table 1, the scattering in the magnetic properties was large. It was found that the scattering was attributed to the scattering in the thickness of the cold sheet, and thus according to the present invention, not only is the cold rolling property improved but also variations in the magnetic properties can be prevented through the prevention of variations in the thickness of the cold rolled sheet.

TABLE 1

| Group | Cold rolling property | Magnetic properties | Classification |
|---|---|---|---|
| A | About 30% caused formation of pores and breaking<br>Variation in sheet thickness was large 0.07–0.13 mm | $\mu_0 \cdot Hc$: $0.007 \times 10^{-4}$ to $0.010 \times 10^{-4}$ (T)<br>$\mu_i$: $12 \times 10^4$ to $19 \times 10^4$<br>$\mu_m$: $21 \times 10^4$ to $33 \times 10^4$<br>$\mu$ (10 kHz): 1900 to 3200 | Comparative |
| B | All material was rollable to a thickness of 0.10 mm<br>Variation in sheet thickness was small: 0.09 to 0.11 mm | $\mu_0 \cdot Hc$: $0.006 \times 10^{-4}$ to $0.007 \times 10^{-4}$ (T)<br>$\mu_i$: $18 \times 10^4$ to $22 \times 10^4$<br>$\mu_m$: $32 \times 10^4$ to $36 \times 10^4$<br>$\mu$ (10 kHz): 2500 to 3800 | Present invention |

EXAMPLE 2

Austenitic stainless steel (SUS 304) comprising 0.053% carbon, 18% chromium, and 8% nickel, with the balance being iron and unavoidable impurities, was vacuum-melted and a thin cast sheet having a thickness of 3.0 mm was prepared therefrom by a twin roll having a roll diameter of 400 mm. The "sags" in a raindrop form having a height of 1 to 2 mm and a "ripple" were scattered over the surface of the thin cast iron.

The above-melted thin cast sheet was divided into two groups, i.e., groups A and B. In the sheets of group B, a steel grit having a diameter of 0.8 mm was blasted by a compressed air stream directed onto the surface of the thin cast sheet for about 20 sec. This caused the whole surface of the thin cast sheet to be covered with a worked portion having an unevenness of 0.2 to 0.5 mm, and the average sheet thickness was 2.9 mm. The worked thin cast sheets were subjected to heat annealing under various conditions of a heating temperature of 600° to 1200° C. and a heating time of zero sec to 3 hr. At this stage, the section of the sheet was observed under a metallurgical microscope to confirm whether or not the surface was covered with a fine grain.

Thereafter, all samples of groups A and B were cold-rolled to 1 mm by a four-stage rolling mill having a roll diameter of 80 mm, and the surface appearance thereof then observed. The results are shown in Table 2.

As is apparent from Table 2, the materials of group B subjected to fine recrystallization had a superior surface appearance.

TABLE 2

| Group | Surface appearance | | Classification |
|---|---|---|---|
| A (Neither grit working nor annealing) | In about half of the materials, cold rolling was interrupted due to cracking. Although the remaining materials were cold-rollable to a thickness of 1 mm, sagged portions recessed and flawed. Uneven pattern occurred in orange peel form. The sheet thickness was nonuniform: 0.75 to 1.05 mm. | | Comparative |
| B (Grit working) | Incomplete formation of fine recrystallized grain layer | Although all the materials were cold-rollable to a thickness of 1 mm, uneven pattern in orange peel form occurred in some. | |
| | Formation of fine recrystallized grain layer | All the materials were cold-rollable to a thickness of 1 mm. No trace of sagged portion observed. No uneven pattern in orange peel form was observed. The sheet thickness was uniform: 0.97 to 1.01 mm. | Present invention |

EXAMPLE 3

A 2.1 mm-thick thin cast sheet of a stainless steel comprising 0.06% carbon, 18.3% chromium, 8.4% nickel, and 0.038% nitrogen, with the balance being iron and unavoidable impurities, was prepared by a method wherein a molten metal was poured into a gap between rotated metallic rolls having a diameter of 300 mm. The thin cast sheet was divided into two groups, i.e., groups A and B. Both surfaces of the thin cast sheets of each group were scanned a number of times by the "air grit blasting machine" wherein a small sand particle together with a high sped stream of compressed air was impinged against the steel sheet. The sand particles had an average particle diameter of 0.8 mm. The thin cast sheets thus scanned were heat-annealed at 1150° C. for 2 min, subjected to a removal of scale formed during the annealing, with aqua regia, and then cold-rolled to a sheet thickness of 0.7 mm. After a rolling oil was washed out, the cold rolled sheets were subjected to a final annealing at 1100° C. for 60 sec, and the surface appearance was observed. Blasting conditions (number of times of scanning for varying the degree of working), the degree of fine recrystallization on the surface of the thin sheets in the heat annealing at 1150° C. after blasting, and the results of observation of the surface appearance of the resultant cold-rolled sheets are shown in Table 3.

TABLE 3

| Group | Number of times of blasting | Presence of fine recrystallized grain of surface after annealing of cast slab (%) | Results of observation of surface appearance | Classification |
|---|---|---|---|---|
| A | 0 | 0 | Dim color, occurrence of many orange peel patterns | Comparative |
| | 1 | 60 | Dim color, occurrence of orange peel pattern | |
| B | 3 | 100 | Mirror surface, no orange peel pattern | Present Invention |
| | 5 | 100 | Mirror surface, no orange peel pattern | |
| | 10 | 100 | Mirror surface, no orange peel pattern | |

As apparent from Table 3, the surface appearance was remarkably improved through the application of the present invention.

EXAMPLE 4

Thin cast sheets having a thickness of 2.5 mm (group A), 1.3 mm (group B) and 0.9 mm (group C) and comprising 0.06% carbon, 3.2% silicon, 0.71% manganese, 0.025% sulfur, 0.019% sol. aluminum, 0.008% nitrogen, and 0.15% tin, with the balance consisting essentially of iron, were prepared by a method wherein a molten metal was poured into a gap between rotated metallic twin rolls having a diameter of 300 mm, while cooling the resultant sheet with water at the outlet of the twin roll. Both surfaces of these thin cast sheets were scanned a number of times by the "air grit blasting machine" wherein a small sand particle together with a high speed stream of compressed air was impinged against the steel sheet. The average particle diameter of the sand was 1 mm for group A, 0.7 mm for group B and 0.5 mm for group C. The thus scanned steel sheets were annealed at 1100° C. for 2 min, and pickled and cold-rolled to a final sheet thickness at a draft of 86%. The steel sheets were subjected to decarburizing annealing in a wet hydrogen gas stream, coated with MgO as an annealing releaser, and subjected to secondary recrystallization.purification annealing at 1180° C. for 15 hr in a dry hydrogen gas stream. The blasting conditions (number of times of scanning for varying the degree of working), the degree of fine recrystallization on the surface of the steel sheets after the annealing at 1100° C. after blasting, and the final magnetic properties are shown in Table 4.

TABLE 4

| Group | Number of times of blasting | Sheet thickness of thin cast sheet (thickness of product) | Presence of fine recrystallized grain on surface after annealing of cast slab (%) | Magnetic properties/ Magnetic density $B_{10}$ (T) | Classification |
|---|---|---|---|---|---|
| A | 2.5 mm | 0 | No | 1.4–1.81 | Comparative |
| | | 2 | Yes | 1.89–1.92 | Present invention |
| | (0.33 mm) | 3 | Yes | 1.90–1.93 | Present invention |
| | | 5 | Yes | 1.90–1.93 | Present invention |
| B | 1.3 mm | 0 | No | 1.6–1.91 | Comparative |
| | | 2 | Yes | 1.89–1.92 | Present invention |
| | (0.17 mm) | 3 | Yes | 1.89–1.93 | Present invention |
| | | 5 | Yes | 1.90–1.93 | Present invention |
| C | 0.9 mm | 0 | No | 1.6–1.90 | Comparative |
| | | 2 | Yes | 1.87–1.91 | Present invention |
| | (0.12 mm) | 3 | Yes | 1.89–1.93 | Present invention |
| | | 5 | Yes | 1.89–1.93 | Present invention |

INDUSTRIAL APPLICABILITY

As apparent from the foregoing description, rollable metal sheets prepared from a quench solidified thin cast sheet according to the present invention have a far better cold rolling property than metal sheets prepared from the conventional quench solidified thin cast sheet. In particular, in the case of a stainless steel, the products prepared according to the process of the present invention have a superior surface appearance compared to the products prepared by the conventional process. Further, in the case of a grain oriented silicon steel, the products according to the present invention have superior magnetic properties. Further, the present invention increases the practicability of the process wherein a step of hot rolling has been eliminated, which renders the present invention very useful to industry from the viewpoints of energy saving, and less plant and equipment investment.

We claim:

1. A process for preparing a rollable metal sheet from a quench solidified thin cast sheet as a starting material, which comprises a step of continuously feeding a molten metal on a cooling material having one or two cooling surfaces being transferred and renewed for quench solidification, to thereby prepare a thin cast sheet; a step of impinging small rigid body particle against the surface of the thin cast sheet, to work the cast sheet; a step of heat-annealing the worked sheet in such a manner that the worked region becomes a fine recrystallized grain layer; and a step of subjecting the sheet to a cold rolling.

2. A process according to claim 1, wherein the thin cast sheet has a thickness of 10 μm to 6.0 mm.

3. A process according to claim 1 or 2, wherein an oxide present on the surface of the thin cast sheet is removed after the step of heat annealing.

4. A process according to claim 1 or 2, wherein a heat treatment for working is conducted after the step of cold rolling.

5. A process according to claim 1, wherein the molten metal is a stainless steel.

6. A process according to claim 5, which comprises projecting a small rigid body comprising a shot or grit onto the surface of the thin cast sheet of a stainless steel, to form a worked layer on the surface of the thin cast sheet, heat-annealing the thin cast sheet at 700° to 1300° C. for 1 sec to 10 min to form a layer comprising a fine recrystallized grain having an average diameter of 100 μm or less in the resultant surface layer having a depth of 30 μm or more on the thin cast sheet, and subjecting the thin cast sheet to cold rolling and final annealing to prepare a stainless steel sheet having a required surface appearance.

7. A process according to claim 1, wherein the molten metal comprises 2.5 to 6.5% by weight of silicon and an inhibitor ingredient necessary for a grain oriented silicon steel sheet, with the balance being iron and unavoidable impurities.

8. A process according to claim 7, which comprises a step of continuously quench-solidifying the molten metal to prepare a thin cast sheet having a thickness of 0.5 to 2.5 mm; impinging small rigid body particles against the resultant thin cast sheet, to form a worked layer on the surface thereof; heat-annealing the thin cast sheet at 650° to 1300° C. for 30 min or less to form a fine recrystallized layer in the collision worked surface layer region; and subjecting the thin cast sheet to final cold rolling at a draft of 50 to 98% and at least once annealing at a temperature of 600° to 1300° C.

9. A process according to claim 8, wherein the thin cast sheet is subjected to rolling and an intermediate annealing before final cold rolling.

10. A process according to claim 1, wherein the molten metal is one of nickel-iron alloy, cobalt-iron alloy, nickel metal, aluminum metal and copper metal.

11. A process according to claim 10, which comprises a step of continuously quench-solidifying the molten metal to prepare a thin cast sheet having a thickness of 10 μm to 6.0 mm; impinging small rigid body particles against the resultant thin cast sheet, to form a worked layer on the surface thereof; heat-annealing the thin cast sheet to form a fine recrystallized layer in the impingement worked surface layer re and subjecting the thin cast sheet to cold rolling.

12. A process according to claim 11, wherein the thin cast sheet comprising nickel-iron alloy is heat-annealed at a temperature of 650° to 1300° C.

13. A process according to claim 11, wherein the thin cast sheet comprising aluminum is heat-annealed at a temperature of 300° to 600° C.

14. A process according to claim 11, wherein the thin cast sheet comprising copper is heat-annealed at temperature of 350° to 900° C.

* * * * *

UNITED STATES PATENT AND TRADEMARK OFFICE

CERTIFICATE OF CORRECTION

PATENT NO. : 5,286,315

DATED : February 15, 1994

INVENTOR(S) : Kenzo IWAYAMA, et al.

It is certified that error appears in the above-indentified patent and that said Letters Patent is hereby corrected as shown below:

Column 2, line 55, change "steep" to --steel--.

Column 4, line 17, change "for" to --far--.

Column 6, line 2, between "of" and "rolling" insert --the--.

Column 7, line 60, change "gain" to --grain--.

Column 7, line 64, change "gain" to --grain--.

Column 8, line 10, change "gain" to --grain--.

Column 9, line 24, change "gain" to --grain--.

Column 10, line 64, change "iron" to --sheet--.

Column 12, line 21 (Table 3), change "of" to --on--.

Column 13, line 15, change "tallization.purification" to --tallization-purification--.

Column 14, line 4, change "particle" to --particles--.

UNITED STATES PATENT AND TRADEMARK OFFICE

CERTIFICATE OF CORRECTION

PATENT NO. : 5,286,315

DATED : February 15, 1994

INVENTOR(S) : Kenzo IWAYAMA, et al.

It is certified that error appears in the above-indentified patent and that said Letters Patent is hereby corrected as shown below:

Column 16, line 3, change "re and" to --region; and--.

Signed and Sealed this

Sixteenth Day of August, 1994

Bruce Lehman

*Attest:*

BRUCE LEHMAN

*Attesting Officer*

*Commissioner of Patents and Trademarks*